US005616083A

United States Patent [19]

Subbaraman et al.

[11] Patent Number: 5,616,083

[45] Date of Patent: Apr. 1, 1997

[54] APPARATUS FOR GENERATING A DEEP, LAMINAR VORTEX

[76] Inventors: Ramesh B. Subbaraman, 207 N. Acacia, Apt. D, Fullerton, Calif. 92631; Barry R. Brucker, 805 N. Roxbury St., Beverly Hills, Calif. 90210

[21] Appl. No.: 508,329

[22] Filed: Jul. 27, 1995

[51] Int. Cl.[6] ..... A63H 23/08

[52] U.S. Cl. ..... 472/67; 472/65; 366/314

[58] Field of Search ..... 472/67, 128, 129, 472/137, 65; 366/262, 263, 265, 266, 314, 317; 4/491

[56] References Cited

U.S. PATENT DOCUMENTS

| | | | |
|---|---|---|---|
| 2,853,280 | 9/1959 | Cusi | 366/263 X |
| 3,635,448 | 1/1972 | Okada | 259/108 |
| 4,676,718 | 6/1987 | Sarvanne | 415/213 A |
| 4,836,521 | 6/1989 | Barber | 272/32 |
| 5,387,159 | 2/1995 | Hilgert et al. | 472/128 |
| 5,417,615 | 5/1995 | Beard | 472/131 X |

FOREIGN PATENT DOCUMENTS

| | | |
|---|---|---|
| 3-257262 | 11/1991 | Japan . |
| 3-257263 | 11/1991 | Japan . |

OTHER PUBLICATIONS

Rieger et al., "Vortex Depth in Mixed Unbottled" Vessels, Chem. Eng. Sci.,1979,vol. 34, pp. 397–403.

*Primary Examiner*—Kien T. Nguyen

*Attorney, Agent, or Firm*—Fischbach, Perlstein, Lieberman & Yanny

[57] ABSTRACT

An apparatus for generating a deep U-shaped vortex, with the vortex being of sufficient height to include a relatively large air well in its center. The apparatus may be used as an amusement park ride, wherein it comprises an observation platform, a large vessel partially filled with liquid, and an impeller to rotate the liquid within the vessel and thereby create a vortex of liquid within the vessel. When the vortex is created, an air well develops in the center of the vessel, with the air well being of sufficient size to allow the entry of the observation platform therein, with the observation platform being surrounded below and at its sides by the rotating liquid, but without coming into contact with the rotating liquid.

13 Claims, 5 Drawing Sheets

APPARATUS FOR GENERATING A DEEP, LAMINAR VORTEX

BACKGROUND OF THE INVENTION

1. Field of the Invention:

The present invention relates to an apparatus for generating a deep U-shaped vortex, and more particularly to the use of such a device as an amusement ride to allow passengers to be in the center of a swirling vortex of water.

2. Brief Description of the Prior Art:

The vortex is a fluid-flow phenomenon observed in unbaffled, axially stirred, vertical vessels. Generally, the word "vortex" refers to the deep-welling fluid flow of a liquid, involving rotation about an axis, especially as in a whirlpool. Technically, a vortex is produced by the centrifugal force acting on the rotating liquid. The centrifugal force, due to rotation, acts upon the mass of liquid, drawing it away from the center and causing it to rise along the wall of the vessel, thereby resulting in a deep well of air along the central axis of rotation. The overall phenomenon of liquid rising at the outer perimeter due to the centrifugal force created by the rotation of the liquid mass, and the resultant deep-welling of air, is termed a vortex.

"Man-made" deep vortices typically occur in the central region of mechanically rotated, symmetric, unbaffled vessels containing low viscous liquids, such as water. Naturally-occurring vortices can be observed at the eddies of ocean currents and in the wake of other flowing masses of water past stationary bodies. For example, a well defined, naturally-occurring vortex regularly occurs in the Naruto Strait which connects the Inland Sea of Japan and the Pacific Ocean.

OKADA (U.S. Pat. No. 3,635,448) describes a vortex generator placed or formed in the bottom of a pond or pool for generating a decorative vortex within the pond or pool. The OKADA vortex generator includes a vessel with an impeller at the bottom of the vessel, and the vessel having a generally cylindrical wall that is shaped like an inverted cone. The OKADA device is used to create small, decorative vortices on the surface of a pond or pool. Similar devices are shown in Japanese patents 3-257262 and 3-257263, which were both issued to KAMIKUBO.

BARBER (U.S. Pat. No. 4,836,521) shows a whirlpool amusement ride, which simulates traverse of the edge of a whirlpool. In BARBER, passengers ride on a floating vehicle which travels up and over a rotatable annular member which rotates around a pond of water. In contrast to the current invention, BARBER includes a shallow whirlpool, and the passenger vehicles float on the water's surface.

Previous vortex generators create V-shaped vortices which are conducive to mixing. The prior art does not teach the creation of deep U-shaped, near-laminar flow vortices.

SUMMARY OF THE INVENTION

This invention is a vortex generator specifically designed to generate a vortex having a deep and wide U-shaped air well. The invention essentially comprises a vessel for holding liquid, with a liquid driver for inducing rotation of the liquid within the vessel. As the liquid is rotated, the liquid rises along the outer periphery of the vessel while falling in the vessel center, thus creating a deep and wide U-shaped air well within the liquid.

The vessel comprises a bottom shell and a generally cylindrical wall. In the preferred embodiment, the cylindrical wall is angled slightly outward from the vertical. This facilitates the rotating liquid to rise along the wall of the vessel, thereby promoting the development of a deep and wide U-shaped air well.

The bottom shell and generally cylindrical wall preferably are joined at a rounded corner, with said rounded corner serving to reduce disruptions to the fluid as said fluid flows from the center of the vessel and up the sides of the wall.

In the preferred embodiment, the liquid driver comprises an impeller positioned at the bottom of the vessel. The impeller is designed to encourage smooth, laminar flow from the center of the vessel to the outer perimeter of the vessel. In the preferred embodiment, the impeller comprises a modified disc-style turbine, with the disc extending across the diameter of the impeller.

Other liquid drivers may also be used such as jets or other impelling devices. Alternatively, the entire vessel may be rotated, thus inducing rotation of the liquid contained within. The driver used should be capable of inducing rotation smoothly, so as to maintain a near-laminar flow.

In one embodiment of the invention, the vortex is used for entertainment purposes, specifically as an amusement ride. In such an embodiment, the apparatus is sized so as to generate a vortex having an air well of sufficient size to accommodate one or more observers. The observers would preferably be transported into the air well in an observation platform, with the observation platform sized to fit within the air well of the vortex. This embodiment of the invention is intended to provide a viewer with a large, steady-state, inside view of a vortex, with the primary purpose being entertainment. This embodiment may also be used for other purposes, such as education and research, by allowing the observer to view the vortex from within.

A vessel sized for use as an amusement ride may comprise a vessel approximately 80 feet in diameter and 100 feet in depth. The vortex air well that develops in a vessel of such size would have a diameter of 50 to 60 feet and a depth of about 70 feet. The apparatus develops and maintains the vortex and associated air well, with the air well relatively stable under steady operating conditions. It is planned to lower the observation platform, which may be in the form of an enclosed viewing cabin, into the air well, so that the observers are surrounded below and on all sides by the rotating liquid.

When used as an amusement park ride, the invention may also include safety features to ensure the security of the passengers.

The above and other objects and advantages of the present invention will become more apparent when read in conjunction with the following description of certain preferred embodiments of the invention.

DETAILED DESCRIPTION OF THE PREFERRED EMBODIMENT

Figure 1:
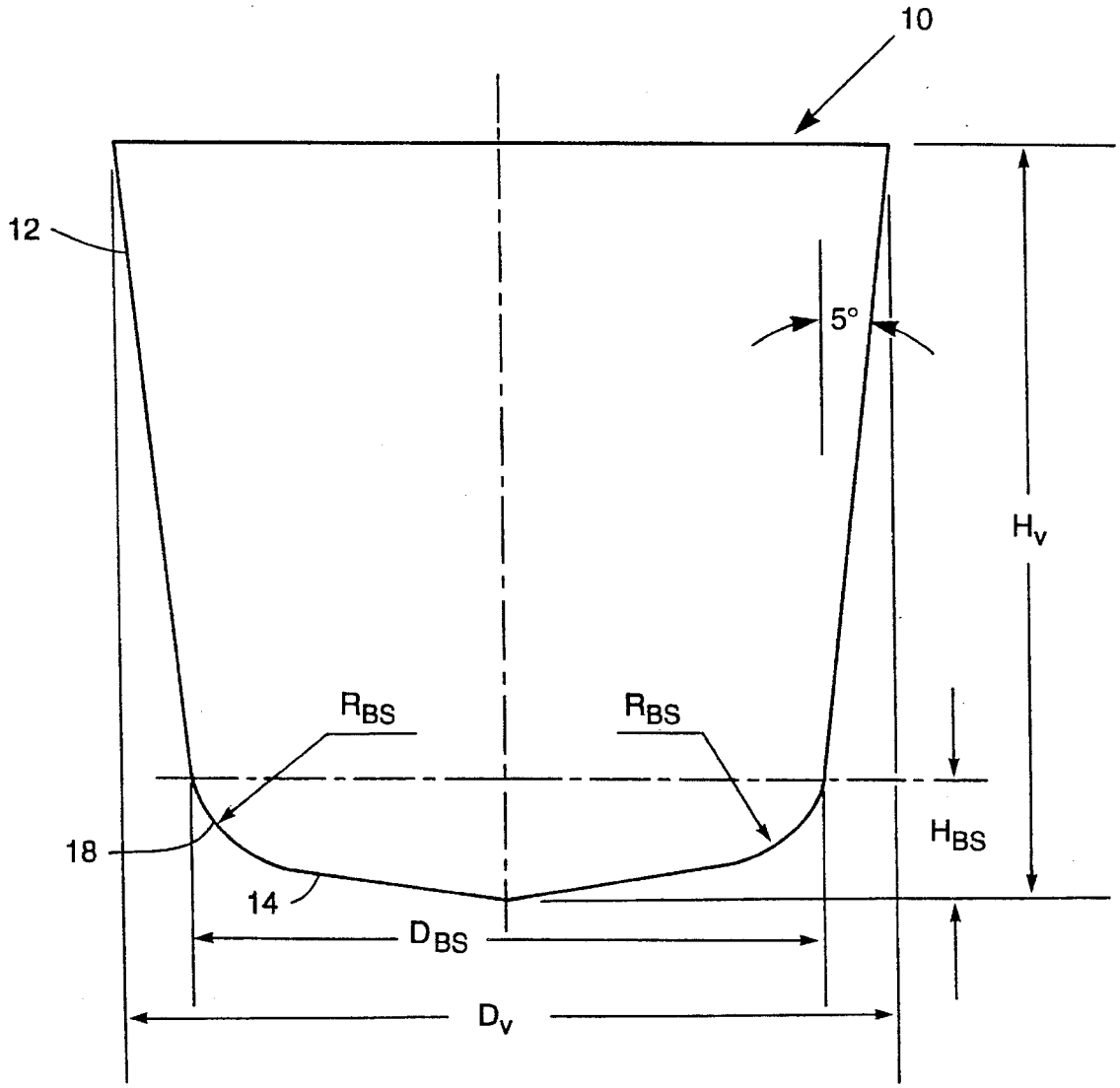
FIG. 1 is a vertical cross-section of a vessel according to a preferred embodiment of the invention.

FIG. 1 shows in vertical cross-section a vessel 10 according to a preferred embodiment of the invention. The vessel essentially comprises two portions: a top section, in the form of a generally cylindrical wall 12, and a bottom shell 14, which in this embodiment is a shallow inverted generally conic section.

In the embodiment shown, the vessel 10 has a height $H_v$ to diameter $D_v$ ratio of 0.7 or greater and, preferably, 1:1 to 1.25:1. However, the height-to-diameter ratio is not required for operation of the invention and can be varied depending upon the depth and width of the vortex desired.

The vessel wall 12 has a slight outward inclination, which in the embodiment shown is 5 degrees from the vertical. This outward inclination may vary from approximately 0 to 15 degrees. The purpose of the outward inclination is to promote the rise of liquid upward along the wall, thus facilitating the development of a deep U-shaped vortex.

The vessel wall 12 is preferably smooth and free of baffles and other obstructions that may interfere with the axial flow of liquid in the vessel 10. As an exception to this general rule, where liquid rotation is induced by rotation of the vessel itself, baffles or other obstructions may actually be desirable, as they would encourage rotation of the liquid in a similar manner to that of impeller vanes.

In the embodiment shown in FIG. 1, the bottom shell 14 is a shallow inverted conic section, having a diameter $D_{BS}$ to height $H_{BS}$ ratio of on the order of 1:0.2. The shallow conic shape of the bottom section facilitates the outward flow of liquid, thus facilitating the development of a deep U-shaped vortex. It should be noted that numerous other bottom shapes, including varying diameter to height ratios, although possibly not as efficient as the embodiment of FIG. 1, may also be used without departing from the teachings of this invention.

Where the cylindrical wall 12 and the bottom shell 14 meet, they may form a rounded corner section 18 having a radius of curvature of $R_{BS}$, as shown in the embodiment of FIG. 1. The rounded corner 18 facilitates the flow of liquid outward from the bottom shell and up the cylindrical wall, whereas a sharp, not rounded corner might obstruct, introduce turbulence to, or otherwise interfere with the flow of liquid, resulting in the creation of eddies and other turbulent disruptions. That would lead to a V-shaped (as opposed to U-shaped) vortex. In the embodiment shown, $R_{BS}$ is approximately ¼ of the diameter $D_{BS}$ of the bottom shell.

Figure 2A:
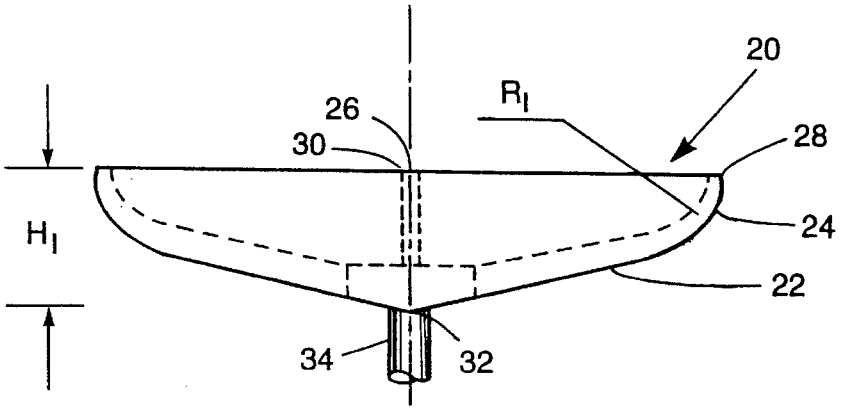
FIG. 2*a* is a vertical cross-section view of an impeller according to a preferred embodiment of the invention.
Figure 2B:
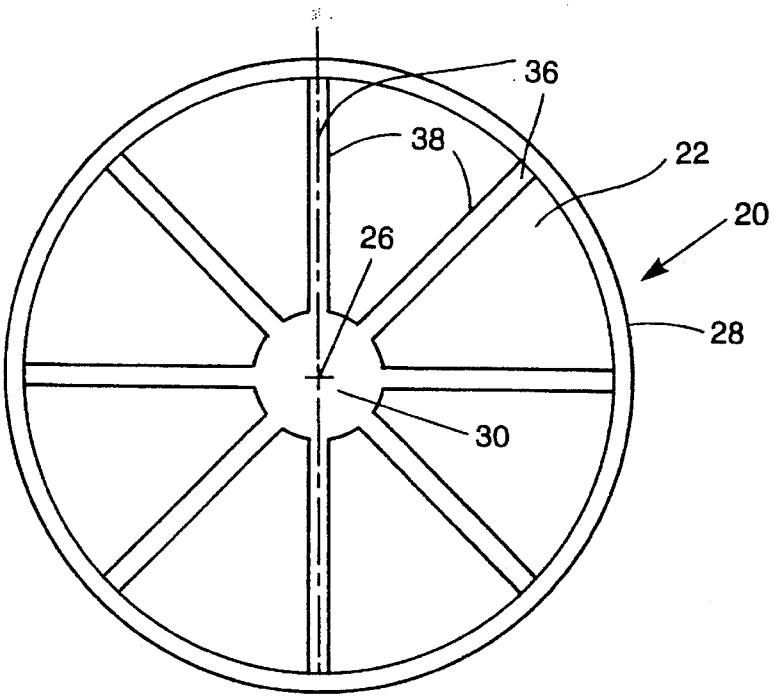
FIG. 2*b* is a top plan view of an impeller according to a preferred embodiment of the invention.

FIGS. 2*a* and 2*b* show an impeller 20 in accordance with one embodiment of the invention. The impeller is used to induce rotation of the liquid in order to produce the vortex. It should be noted that other methods and systems may be used to induce rotation of the liquid, such as jets of liquid located about the inner periphery of the vessel. Another method might involve rotating the entire vessel to induce rotation of the liquid within. However, it is believed that the use of a mechanical impeller is preferable in view of its efficiency and effectiveness.

In the embodiment shown, the impeller 20 is a modified disc-style turbine, with the impeller dish 22 being in the shape of an inverted minor (i.e., shallow) cone with a rounded outer portion 24, with the rounded outer portion of the cone having a radius of curvature $R_I$. The impeller dish 22 extends from the hub center 26 to the impeller's circumferential edge 28. The overall height of the impeller $H_I$ extends from the hub's flat upper face 30 to the impeller dish's outer apex 32. The impeller is supported and rotated at its outer apex by an axial shaft 34. The impeller should have at least 2 blades or vanes, with 6 or 8 preferred.

In the embodiment shown, the impeller has eight blades or vanes 36 that are at 90° to the horizontal and are equispaced about the impeller and radially pitched. The hub face 30 is in the same plane as are the vanes' top leading edges 38. The vanes are vertically positioned, i.e., at right angles to the horizontal plane of the impeller. Other variations on the number, shape, and position of the impeller vanes may also be used, depending on the liquid used, the size of the vessel and impeller, the desired shape of the air well, and other parameters.

The shape of the conical impeller dish 22, as well as of the vanes 36, influence the shape of the generated vortex, and particularly the shape of the bottom of the vortex. It has been observed that a wider impeller, with an impeller diameter to vessel diameter ratio of 0.80 and greater, tends to create a wider air well within the vortex. The shape and smooth flow pattern are greatly affected by the shape and speed of the impeller.

Figure 2C:
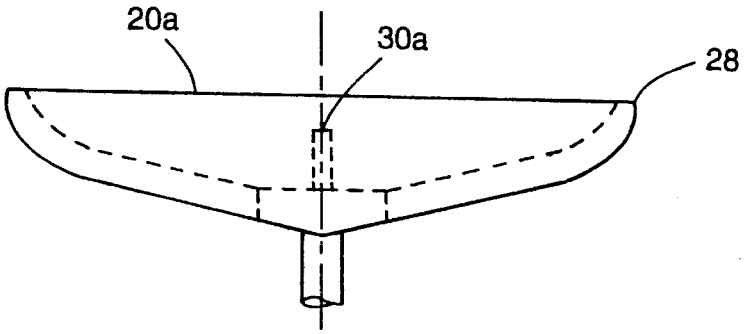
FIG. 2*c* is a vertical cross-section view of an impeller according to another embodiment of the invention

The impeller shape may be altered in the height dimension to promote or improve vortex size and shape. As shown in FIG. 2*c*, the top facial portion of the hub 30*a* is lower than the top leading edge of the peripheral circumference 28, with the vanes increasing fin height toward the peripheral circumference. This modification permits the impeller to rotate at relatively higher speeds, due to a wider layer of liquid between the air and the vanes. The taller vanes at the periphery aid in moving larger quantities of water along the wall of the vessel. This raises the overall height of the vortex well.

Figure 3:
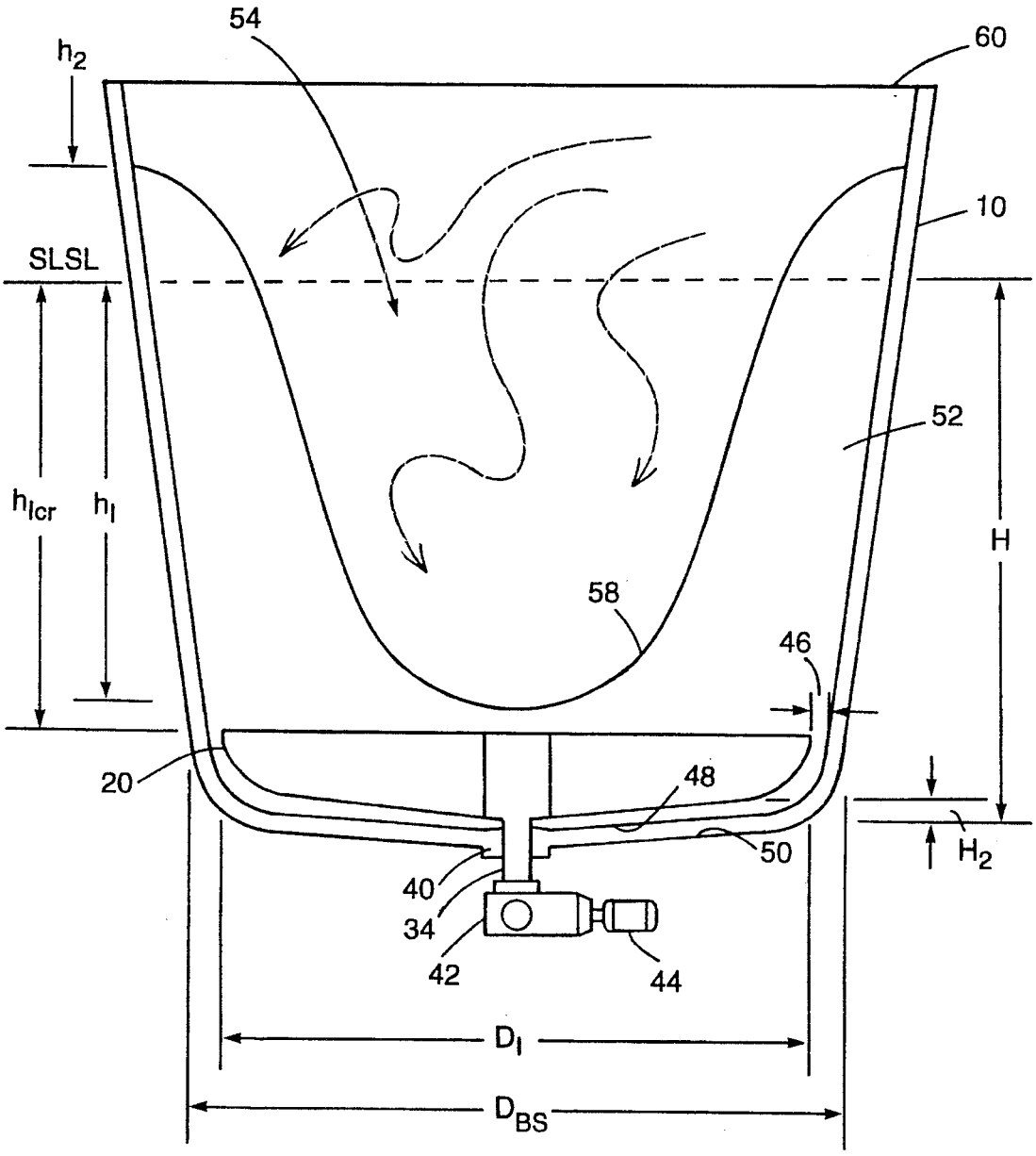
FIG. 3 is a vertical cross-section view of a vortex generator according to a preferred embodiment of the invention.

FIG. 3 shows an impeller and vessel combination in accordance with one embodiment of the invention. The impeller is similar to that shown in FIGS. 2*a* and 2*b*, consisting of a modified disc-style turbine. The impeller is positioned in the center of the bottom of the vessel 14, and is secured and powered by an axial shaft 34. A mechanical seal 40 surrounds the shaft 34 where it exits the vessel bottom 14, thereby preventing liquid from leaking from the vessel. The shaft itself is driven by an appropriate power source, also described as a prime mover, which in the embodiment shown in FIG. 3 includes a gear reduction unit 42 and electric motor 44.

In the embodiment shown in FIG. 3, the clearance 46 between the circumferential edge of the impeller 28 and the vessel wall 12 is approximately ⅕ of the height $D_{BS}$ of the bottom shell. The curvature of the impeller's lower surface 48 is generally parallel to the curvature of the vessel's bottom face 50. In the embodiment of FIG. 3, the clearance between the impeller's lower surface 48 and the vessel bottom face 50 is approximately a fifth of the height $H_{BS}$ of the bottom shell.

In operation, the vessel 10 is filled with liquid 52 to a Static Liquid Surface Level (SLSL). As the impeller is rotated, the rotating liquid is forced outward toward and up the vessel wall 12. The liquid surface, also known as the liquid/air interface, is thus deformed in cross-section, creating a deep U-shaped air well 54 within the rotating liquid.

The impeller 20 and vessel 10 are designed to encourage the development of a smooth, near-laminar vortex, with the impeller displacing a large amount of water from the center of the vessel. As a result, the mid-section 56 of the liquid/air interface is steeper than typical vortices, and the bottom section 58 of the liquid/air interface is more rounded. The air well 54 thus created is both wide and deep.

The vortex created by this embodiment of the invention should not be confused with the type of swirling motion that is often seen in blenders and mixers. Blenders and mixers create turbulent, mixing fluid flow and often draw air into the liquid, thus producing deep V-shaped "vortices". In contrast, this embodiment of the current invention creates a smooth, substantially laminar rotation of the liquid resulting in a generally U-shaped vortex. The unique shape of the impeller and vessel, and their preferred assembly, were specifically designed for these features.

The rounded corner 18 where the vessel wall 12 joins the bottom shell 14 encourages the smooth flow of liquid and prevents the development of eddy mixing currents. The prevention of eddy currents prevents both turbulence and vibration.

The modified disc shape of the impeller 20 is such that it can rotate and maintain a larger body of liquid in motion. When the impeller is rotated, the body of liquid 52 from the center of the vessel 10 is drawn to the bottom and expelled to the periphery. This causes the air well 54 to form in the center, induces liquid to rise along the vessel wall 12, and creates a laminar flow vortex.

The shape of the vessel 10 and of the impeller 20 influence the development and maintenance of the vortex. The outward angular deflection of the vessel wall aids in developing an air well 54 that is wide and deep. The wider top section 60 of the vessel facilitates more volume for the rising liquid to occupy.

In the embodiment shown in FIG. 3, the impeller 20 is of a bottom entry type, centrally positioned in the bottom of the vessel 10. This facilitates the development of an efficient, U-shaped air well 54, while allowing the air well to remain accessible from the top.

The terms used in FIG. 3 are defined as follows:

$D_V$: vessel diameter $D_I$: impeller diameter

SLSL: Static Liquid Surface Level, which is the level of the liquid surface when the liquid is at rest, i.e., non-rotating.

H: height of the Static Liquid Surface Level (SLSL).

$h_1$: depth of the liquid/air interface as measured from the SLSL.

$h_2$: height of the liquid/air interface above the SLSL.

$H_2$: clearance height between the impeller and the vessel bottom.

$h_{1cr}$: critical depth of the liquid/air interface, as measured from the SLSL, at which the air well contacts the impeller.

Note that the overall height of the liquid/air interface, which equals the overall depth of the air well 54, is equal to $h_1+h_2$.

In the preferred embodiment, the liquid used is water. The water used would typically have the following properties:

Purity: 99.95%

Specific Gravity: 1.0@25° C. and at an atmospheric pressure of 14.696 pounds per square inch Viscosity: 1.0 Centipoise@25° C. and 14.696 PSI f atmospheric pressure The behavior of vortices in unbaffled vessels was described in some detail in the technical paper "Vortex Depth In Mixed Unbaffled Vessels," by F. Rieger, et al. from the Czech Technical University. That article appeared in *Chemical Engineering Science,* 1979, vol. 34, pp. 397–403, and is incorporated herein by reference. Of particular interest in that article are equations describing control of impeller speeds and vortex depth as a function of various parameters, including the properties of liquid and of the impeller.

In the preferred embodiment of the invention, the impeller drive system is capable of varying and controlling the speed of the impeller. The impeller drive system may include a braking apparatus for opposing and stopping the rotation of the impeller.

The speed of the impeller 20 should be maintained below the critical speed, which is the speed where the air well 54 becomes deep enough to contact the impeller. When such contact occurs, air becomes drawn and entrained into the impeller, thereby causing the onset of a two-phase turbulent mixing between the air and liquid. Besides disturbing the vortex shape and flow, such contact induces vibrations and other stresses on the impeller due to uneven inertial loads.

The invention may further include vortex monitors, which may comprise various sensors and other devices that monitor various aspects of the vortex. Such devices may include: sensors to determine the rotational speed of the liquid at various depths; sensors to indicate the heights of the SLSL on the vessel wall; sensors to track the liquid's temperature, density, and compositions; sensors to indicate the impeller speed; etc.

Figure 4:
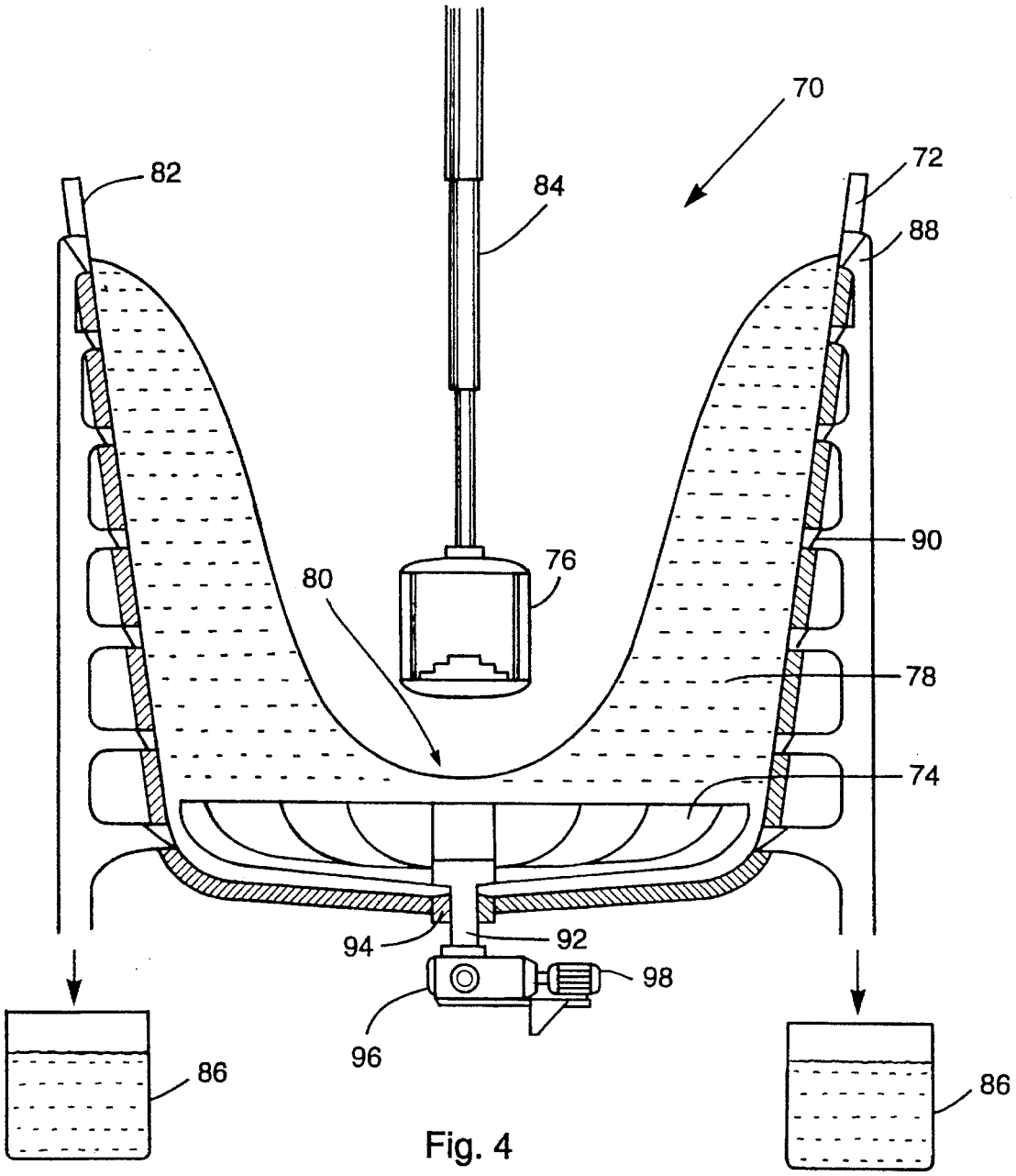
FIG. 4 is a vertical cross-section view of a vortex generator used as an amusement ride according to a preferred embodiment of the invention.

FIG. 4 shows a preferred embodiment of the invention wherein the vortex generator is used as part of an amusement ride 70. The apparatus shown essentially comprises a vessel 72 and impeller 74, with the addition of an observation platform 76 and various control, entertainment, and safety features.

In the embodiment shown, the observation platform 76, also called a ride chamber, is sized to accommodate one or more passengers and to enable the passengers to view the vortex of liquid 78 swirling around the platform.

The observation platform 76 may be constructed with various methods and materials. For example, in one embodiment the platform may comprise a cylindrical cubicle of steel frame and clear plexiglass wall construction.

In the embodiment shown, the observation platform 76 is introduced into the air well 80 from the top of the vessel, through the use of a telescoping boom 84. Other methods of transporting the platform into and out of the air well may also be used, such as elevator cables.

When used for entertainment purposes, such as in the amusement park ride 70 shown in FIG. 4, the development of a smooth, near-laminar rotation of the liquid 78, such as that created by the embodiment shown in FIGS. 1 through 3, is generally desired. However, a mixing, churning flow may also be used for entertainment purposes, although such flows typically consume more energy and induce greater strains on the apparatus. An alternative embodiment may include varying certain parameters of the apparatus, such as impeller speed, in order to change the vortex from a smooth, laminar rotation to a turbulent, mixing flow (and vice versa). For example, the impeller speed may be increased to critical speed, causing the air well to contact the impeller and thereby introducing large amounts of air into the liquid. The resulting rapid change in the appearance of the vortex, especially as viewed from inside the air well, can add to the visual impact of the ride.

Another element in FIG. 4 is an advanced hydraulic system, comprising a liquid reservoir 86 and a feed and drain system. The reservoir 86 is a water-tight compartment able to hold a substantial portion of the volume of the vessel, and possibly having a capacity greater than the volume of the vessel. For example, in one embodiment the reservoir may have a capacity of approximately 125% of the vessel 72. The purpose of the reservoir is to serve as a supply for the vessel, and also to serve as a recipient in case of routine or emergency draining of the vessel.

The reservoir 86 may be a single unit, or may consist of multiple reservoirs whose combined capacity meets the requirements of the system. The reservoirs are preferably located at a level below the main vessel. With any of the above given possibilities it is preferable to have the reservoirs in the periphery of the main vessel and not directly under it, which increases the system safety and seismic integrity of the major structural components as well as facilitating access to the reservoirs for maintenance and repairs.

The feed system is essentially a combination of pipelines, pumps and instruments that carry and regulate the flow of liquid 78 from the reservoir 86 to the main vessel 72 and back. In the embodiment shown, the feed system pipelines 88 and valves 90 are located outside and along the vessel wall 82 at various levels.

The drain system is a system of pipelines and valves that are located on the periphery of the vessel wall 82. The drain system pipelines lead radially out from the vessel at various levels. In the embodiment shown in FIG. 4, the feed and drain systems share common pipelines 88 and valves 90. The valves are preferably instrumentally connected to open synchronously to drain all contained liquid en masse at varied levels, which is particularly important in emergency situations. The pipelines lead to the reservoir in the periphery. In a preferred embodiment, the pipelines also allow for the option of draining the water directly to the outside environment or to local sewer or runoff channels, as may be required if the reservoir is full or where more rapid draining is required.

The pipelines are preferably located at a regular circumferential pitch and at various levels along the outer wall of vessel 72. The size of the pipelines is determined according to the throughput of liquid at the respective height along the vessel wall 82.

In the embodiment shown in FIG. 4, the impeller is positioned in the center of the bottom of the vessel 72 and is secured and powered by an axial shaft 92. A mechanical seal 94 surrounds the shaft 92 where it exits the bottom of the vessel, thereby preventing liquid from leaking from the vessel. The shaft itself is driven by an appropriate power source, which in the embodiment shown in FIG. 4 includes a gear reduction unit 96 and motor 98.

Figure 5:
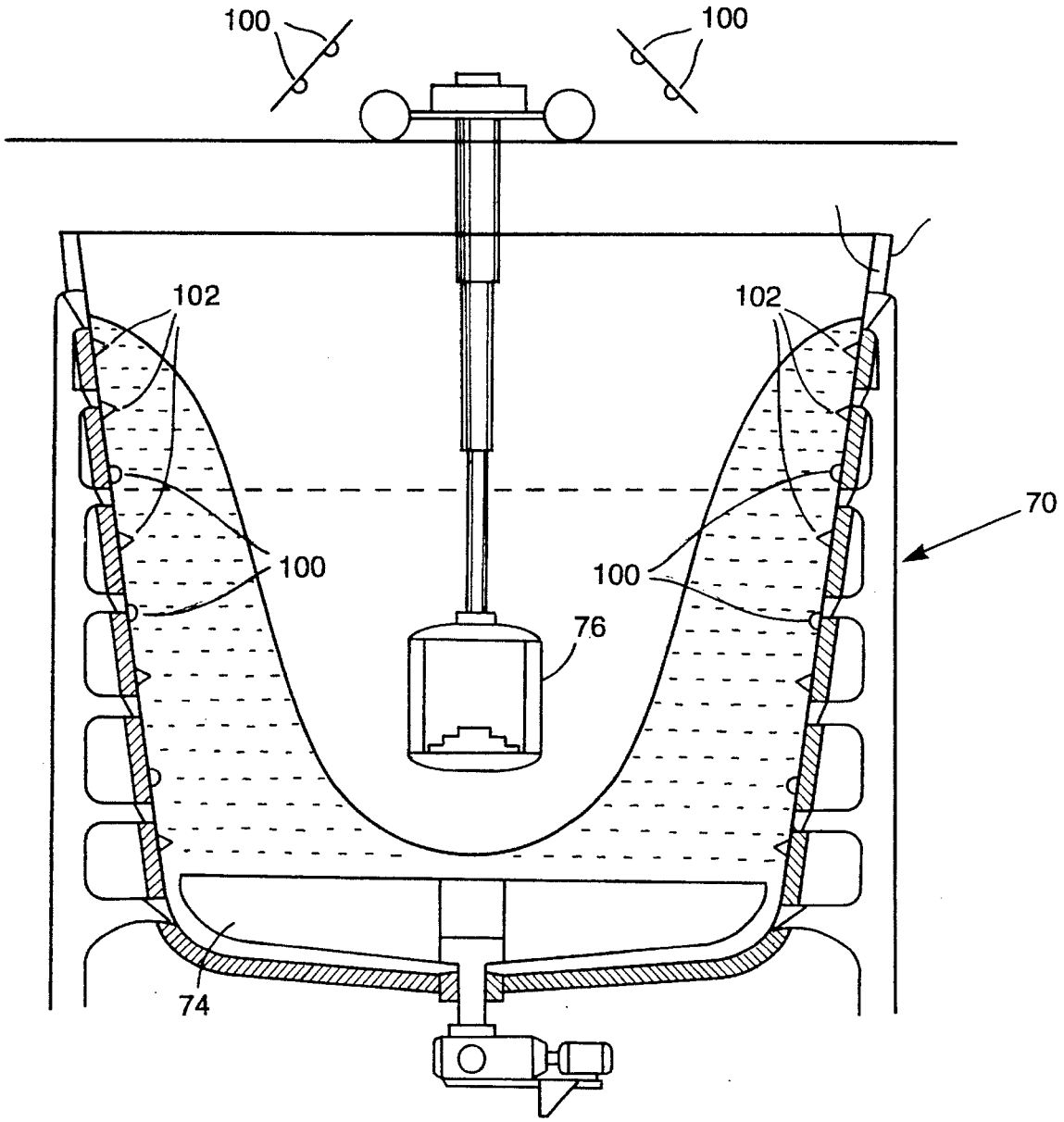
FIG. 5 is a vertical cross-section view of a vortex generator used as an amusement ride, and including special effect lighting, according to a preferred embodiment of the invention.

FIG. 5 shows the system of FIG. 4, but with the addition of special effect elements. In the embodiment shown, the special effects include various illumination devices 100 and ultraviolet light sources 102.

The special effects system may include additional instruments and effect producers, including lighting, sound effects, and others as described below. For example, stationary, mobile, chaser, colored, ultra-violet, infra-red, and strobe lighting may be used to enhance the ride. The lights may be positioned to shine onto the surface of the vortex. Lights may also be positioned in or on the walls of the vessel itself as shown in FIG. 5, so as to illuminate the vortex from behind. Images, both stationary and active, may be projected onto and into the vortex, including images that may be projected from behind the vortex.

The ride may also make use of various sound effects, including natural and synthetic recordings, to enhance the ride.

Patterns may be painted or otherwise imprinted upon the observation platform, vessel walls, and the impeller, using color and patterns that cause psychedelic and illusionary effects.

As an additional effect, the water itself may be colored, for example by the use of dyes, to produce depth and brilliance. The dying effect may be further enhanced in combination with the use of optical brighteners, enhancers, and ultraviolet light.

Another special effect can be selective use of various physical motions of the observation platform itself, including controlled vibration and spin to enhance the ride.

All or some of the above elements may be used, both singularly and in combination, to enhance the ride.

The special effects system is preferably controlled, either wholly or in part, through the use of a microprocessor. The microprocessor, either with or without additional control from a human operator, may be used to coordinate the above-described special effects to maximize the experience on the passengers.

The ride will preferably include various safety systems. As was discussed previously, an emergency drain system is desirable that can rapidly drain the vessel when necessary, as in the case of a serious malfunction or seismic activity. As an additional safety feature, the Static Liquid Surface Level (SLSL) can be maintained at a level below the lowest deployed position of the observation platform. Thus, although in operation the liquid vortex extends up the vessel wall to a height above the occupants in the deployed observation platform, when the liquid stops rotating, as may occur in the case of a power failure, the liquid will settle to a level below the passengers' position. Accordingly, even if the drain system fails and the observation platform is not retracted, the passengers are protected from the water.

The observation platform is preferably supported by at least two means, such as by a telescoping boom and by a set of one or more overhead cables. Thus, in case the primary support fails, the secondary support will support the platform and allow for prompt withdrawal of same.

The observation platform may also include a quick drain system, possibly including pumps and drain vents, to remove any water that may make its way into the platform. This system preferably may be operated from within the observation platform itself. Additionally, in case of a serious malfunction or seismic activity, the ride preferably provides for automatic hoisting of the observation platform. The ride may also provide means within the platform to initiate hoisting of the platform.

As an additional safety measure, the ride preferably includes means to rapidly stop the rotation of the impeller. Such a means may include brakes or other stopping devices, such as a self-tightening and rigid locking system that operates on the shaft of the impeller.

An emergency power supply is also desirable, to provide power in case of a disruption in the local power supply. Such emergency power should include sufficient energy to rapidly remove the observation platform from the air well, as well as being able to operate other system features, and particularly the emergency functions such as draining the vessel.

When used as an amusement park ride or for similar uses, the vortex generator preferably includes a control system, which in the preferred embodiment is a computer than can operate various elements in logical order and sequence. The control system may include various instruments and other devices, including analog, digital, manual, automatic, and micro-processor controlled devices, that can operate all mechanisms in logical order and sequence. For example, the control system may maneuver the observation platform into the vessel, vary the impeller speed, monitor the vortex characteristics, and perform safety procedures. The microprocessor may be wholly automatic, or may require various levels of input and operation by a human operator.

The control system may include various sensors to those described previously with respect to FIG. 3, with said sensors monitoring various parameters of the amusement ride such as impeller speed, liquid rotation, air well depth, observation platform position, liquid depth, lighting, etc.

Operation of the amusement park ride would typically involve the following steps. First, the vessel is filled with water, up to the desired SLSL. Next, the impeller (or other liquid driver) initiates rotation of the liquid, thus creating the vortex. Once the vortex and its associated air well are well established, the observation platform can be lowered into the air well. The special effects system, if present, can be activated to vary and enhance the appearance of the vortex. The observation platform is then removed from the air well, subsequently taking the passengers to a safe point of departure from the ride.

During the operation of the ride, the control system continuously monitors the operation of the system, including power supply and vortex characteristics. If the control system detects a potential problem, the observation platform is immediately withdrawn from the air well.

The above-described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. An amusement ride where passengers may observe a liquid vortex, comprising:

a vessel partially filled with liquid;

an observation platform sized to accommodate one or more observers; and a liquid driver for effecting rotation of said liquid thereby generating a vortex within said liquid having an air well of sufficient size to completely surround said platform without the platform contacting the surface of the liquid.

2. The amusement ride of claim 1 further comprising:

means for moving said observation platform into and out of the air well.

3. The amusement ride of claim 2 wherein said means for moving comprises a telescopic boom.

4. The amusement ride of claim 1 further comprising:

a liquid storage reservoir for containing said liquid outside of the vessel; and drain and fill means for transporting said liquid between the liquid storage reservoir and the vessel.

5. The amusement ride of claim 4 wherein said drain and fill means comprises a plurality of pipelines and valves, said pipelines and valves allowing liquid to be drained from the vessel at various heights along the vessel wall.

6. The amusement ride of claim 1 further comprising illumination devices for illuminating the liquid vortex.

7. The amusement ride of claim 1 wherein said vessel comprises a generally cylindrical wall and a bottom shell joined to form a rounded corner.

8. The amusement ride of claim 7 wherein:

said liquid driver comprises a disc-shaped impeller located at the bottom of the vessel; and said impeller has a bottom surface shaped similar to and running generally parallel to the surface of said bottom shell whereby the vortex generated is U-shaped.

9. A method of generating an observable U-shaped vortex comprising the steps of:

providing an observation platform;

selecting a vessel having a generally cylindrical wall, an upper end and a bottom shell, wherein said wall and said bottom shell join to form a rounded corner;

at least partially filling said vessel with liquid;

rotating said liquid to generate a U-shaped vortex within said vessel;

said vessel having sufficient size and dimensions to create an air well within the U-shaped vortex capable of receiving an observation platform without said platform contacting the liquid within said vessel.

10. The method according to claim 9 wherein the step of rotating said liquid comprises:

placing an impeller at the bottom of said vessel and rotating said impeller to generate the U-shaped vortex within said vessel.

11. The method according to claim 9 comprising the further step of lowering the observation platform into said air well and raising said observation platform out of the air well.

12. The method according to claim 9 further comprising the step of draining liquid from said vessel.

13. The method according to claim 9 further comprising the step of illuminating said liquid vortex.

* * * * *